US005478696A

United States Patent [19]

Arai

[11] Patent Number: 5,478,696

[45] Date of Patent: Dec. 26, 1995

[54] SILVER HALIDE PHOTOGRAPHIC LIGHT-SENSITIVE MATERIAL

[75] Inventor: Takeo Arai, Hino, Japan

[73] Assignee: Konica Corporation, Japan

[21] Appl. No.: 343,049

[22] Filed: Nov. 21, 1994

[30] Foreign Application Priority Data

Dec. 17, 1993 [JP] Japan ..... 5-318350

[51] Int. Cl.[6] ..... G03C 1/06

[52] U.S. Cl. ..... 430/264; 430/598; 430/599; 430/415; 430/434; 430/435

[58] Field of Search ..... 430/264, 598, 430/599, 415, 434, 435

[56] References Cited

U.S. PATENT DOCUMENTS

| | | | |
|---|---|---|---|
| 4,857,446 | 8/1989 | Diehl et al. | 430/510 |
| 4,975,354 | 12/1990 | Machonkin et al. | 430/264 |
| 4,985,338 | 1/1991 | Sakai et al. | 430/264 |
| 5,139,921 | 8/1992 | Takagi et al. | 430/264 |

FOREIGN PATENT DOCUMENTS 0326433 2/1989 European Pat. Off. .

OTHER PUBLICATIONS

Research Disclosure, vol. 159, Item 15930, pp. 62–74, Chen, 1977.

*Primary Examiner*—Thomas R. Neville

*Attorney, Agent, or Firm*—Jordan B. Bierman; Bierman and Muserlian

[57] ABSTRACT

A silver halide photographic light-sensitive material is disclosed. the light-sensitive material comprises a support bearing on the same side thereof a silver halide emulsion layer and optionally a hydrophilic colloid layer, and at least one of the silver halide emulsion layer or the hydrophilic colloid layer contains a hydrazine derivative in a form of dispersion of solid particles and at least one of the silver halide emulsion layer or the hydrophilic colloid layer contains a nucleation accelerator represented by the following formula 1;

(1)

wherein $R_1$, $R_2$ and $R_3$ are each independently a hydrogen atom, a substituted or unsubstituted alkyl group, an substituted or unsubstituted alkenyl group or a substituted or unsubstituted aryl group, provided that $R_1$, $R_2$ and $R_3$ are not a hydrogen atom at the same time and two of $R_1$, $R_2$ and $R_3$ may link to form a ring.

11 Claims, No Drawings

SILVER HALIDE PHOTOGRAPHIC LIGHT-SENSITIVE MATERIAL

FIELD OF THE INVENTION

This invention relates to a silver halide photographic light-sensitive material comprising a support bearing thereon a silver halide light-sensitive emulsion layer and to the process for treating the same and, particularly, to a silver halide photographic light-sensitive material for graphic arts use that is capable of obtaining a high-contrast image.

BACKGROUND OF THE INVENTION

Photomechanical process include a step for converting a continuous-tone original into a halftone-dot image. To the step, an infectious development technique has been applied for reproduce an extra high contrast image.

For a lith type silver halide photographic light-sensitive material applicable to an infectious development, for example, a silver chlorobromide emulsion having an average grain-size of not larger than approximately 0.2 μm with a narrow grain distribution, a uniform grain shape and a silver chloride content of not less than at least 50 mol % is generally used.

Such a lith type silver halide photographic light-sensitive material as mentioned above is able to obtain an image having a high-contrast and a high-resolving power when treating it with an alkaline hydroquinone developer having a low sulfite ion concentration, that is so-called a lith type infectious developer.

However, the above-mentioned lith type developer have such a defect that an air oxidation is liable to occur and that the quality thereof may not be kept stable when the developer is used continuously, because the preservability thereof is extremely inferior. Therefore, as a method for rapidly obtaining a high-contrast image without making use of such a developer as mentioned above, a method for treating a silver halide photographic light-sensitive material containing a hydrazine derivative with an alkaline developer has been disclosed in Japanese Patent Publication Open to Public Inspection (hereinafter referred to as JP OPI Publication) No. 56-106244/1981, for example. According to this method, a developer may be well preserved and a rapid treatment may be performed and, further, an extrahard contrast image may readily be obtained. However, in this method, a treatment has to be carried out with a developer having a pH of not lower than 11.2 for satisfactorily displaying the hard contrast characteristics of a hydrazine derivative.

With a strongly alkaline developer having a pH of not lower than 11.2, the developing agent thereof is seriously oxidized when the developer is exposed to the air. Though the developer is rather stable as compared to the aforementioned lith type developer, there may not often be few instances where an extrahard image may not be obtained by the oxidation of the developing agent thereof, and this fact has hindered the reduction of a developer replenishment.

For remedying such a defect as mentioned above, JP OPI Publication Nos. 63-8646/1988 and 62-91939/1987 disclose each a means for keeping a treatment stability upon controlling an amount to be replenished to the developer for aging so as to meet the quantity of light-sensitive materials subject to the treatment. However such a means as mentioned above requires to use a replenishing device for exclusive use and, at the same time, to use a large amount of aging replenishment especially when a small quantity of light-sensitive materials are to be treated. Therefore, it can hardly be said that the means is able to reconcile a replenishment saving and a treatment stability with each other.

JP OPI Publication Nos. 1-179939/1989 and 1-179940/1989 and U.S. Pat. No. 4,975,354 disclose each a silver halide photographic light-sensitive material containing a hydrazine derivative and a nucleation accelerating agent, that is able to make it hard in contrast even when making use of a developer having a relatively low pH of lower than 11.2, respectively. According to the means, a developer can be improved in preservability. However, it is liable to be affected by a solution fatigue produced by a series of running treatments and a low replenishment can hardly be performed.

On the other hand, it has so far been known that a water-insoluble additive is added in a form of solid particle dispersion to a light-sensitive material, for the purposes of keeping the aging stability of a water-insoluble additive and fixing it in a specific layer. Particularly, European Patent No. 3,26,433 discloses that a hard contrast effect and a coatability improvement are proved by adding a hydrazine derivative in the solid particle dispersion to a light-sensitive material. However, the solid particle dispersion of a hydrazine derivative cannot improve a processing variation produced by a series of running treatments.

SUMMARY OF THE INVENTION

Taking the problems mentioned above into consideration, it is an object of the invention to provide a silver halide light-sensitive material capable of eliminating a sensitivity variation that may be produced by a series of running treatments in processing a silver halide photographic light-sensitive material containing a hydrazine derivative and also capable of providing excellent photographic characteristics even in a low replenishment of developer; and to provide the process of treating the same.

The silver halide photographic light-sensitive material of the invention comprising a support bearing on the same side thereof a silver halide emulsion layer and optionally a hydrophilic colloid layer, and at least one of the silver halide emulsion layer or the hydrophilic colloid layer contains a hydrazine derivative in a form of dispersion of solid particles and at least one of the silver halide emulsion layer or the hydrophilic colloid layer contains a nucleation accelerator represented by the following formula 1;

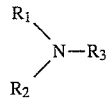

(1)

wherein $R_1$, $R_2$ and $R_3$ are each independently a hydrogen atom, a substituted or unsubstituted alkyl group, an substituted or unsubstituted alkenyl group or a substituted or unsubstituted aryl group, provided that $R_1$, $R_2$ and $R_3$ are not a hydrogen atom at the same time and two of $R_1$, $R_2$ and $R_3$ may link to form a ring. The light-sensitive material is suitable for a processing using a developer having a pH value lower than 11.

DETAILED DESCRIPTION OF THE INVENTION

As compared to a light-sensitive material into which a hydrazine derivative is added in the state where it was dissolved in a solvent and a nucleation accelerator represented by formula (1) is contained, a light-sensitive material containing a hydrazine derivative in the state of a solid dispersion and such a nucleation accelerator as mentioned above is capable of displaying more remarkable running treatment stability. This fact has hardly been expected to the conventional knowledge.

It is allowed to use any one of the conventionally known methods to disperse disperse a hydrazine derivative to solid particles, for example, in the method described in U.S. Pat. No. 4,857,446. To be more concrete, the methods include, for example, a mechanically pulverizing method using a sand mill or a ball mill and a method in which a hydrazine derivative is finely powdered in a chemical method such as an acidic precipitation method and the resulting fine powder thereof is dispersed in a solvent insoluble to the fine powder.

When dispersing the fine powder, it is also allowed to disperse the fine powder forcibly in a means such as a supersonic dispersion, a dispersion and a dispersion method using Manton-Goalin. As described in European Patent No. 326433, there is also such a method that a dispersed solution can be prepared by depositing by pouring a solution of hydrazine derivative into a liquid in which the hydrazine compound can not be dissolved.

A dispersed hydrazine derivative may be added to any step for preparing a light-sensitive material. The steps mentioned above are preferably from a step after completing a physical ripening treatment to a step where the whole additive is completely added to a coating solution. When the hydrazine derivative is added to the emulsion.

The hydrazine derivative may be added in an amount within the range of, preferably, $1\times10^{-7}$ to 1 mol and, particularly, $1\times10^{-6}$ to $1\times10^{-1}$ mols per mol of silver contain in the emulsion of the light-sensitive material.

A dispersed solid particles of hydrazine derivative may be added to any hydrophilic colloidal layer on the side of a support to which a silver halide emulsion layer is arranged. It is particularly preferable to add it to an emulsion layer and/or a hydrophilic colloidal layer adjacent to the emulsion layer.

The hydrazine derivatives preferably applicable to the invention are to have the following structure of formula H, provided however that the invention shall not be limited thereto.

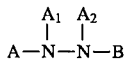

Formula H wherein A is an aliphatic group an aromatic group or a heterocyclic group. An aliphatic group represented by A includes, preferably, those having 1 to 30 carbon atoms and, particularly, a straight-chained, branched or cyclic alkyl group having 1 to 20 carbon atoms, such as a methyl group, an ethyl group, a t-butyl group, an acetyl group, a cyclohexyl group and a benzyl group, and they may also be substituted by a suitable substituent such as an aryl group, an alkoxy group, an aryloxy group, an alkylthio group, an arylthio group, a sulfoxy group, a sulfonamido group, an acylamino group and a ureido group.

In formula H, the aromatic groups represented by A include, preferably, a monocyclic or condensed-ring aryl group such as a benzene ring and a naphthalene ring.

In formula H, the heterocyclic groups represented by A include, preferably, a heterocyclic ring containing a hetero atom selected from the group consisting of at least nitrogen, sulfur and oxygen of a monocyclic or condensed ring including, for example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring.

Those particularly preferable for A include, for example, an aryl group and a heterocyclic group.

An aryl group and a heterocyclic group each represented by A may have a substituent. The typical substituents include, for example, an alkyl group, preferably, those having 1 to 20 carbon atoms, an aralkyl group, preferably, those having a monocyclic ring or a condensed ring each having an alkyl moiety having 1 to 3 carbon atoms, an alkoxy group, preferably, those having an alkyl moiety having 1 to 20 carbon atoms, a substituted amino group, preferably, an amino group substituted by an alkyl or alkylidene group having 1 to 20 carbon atoms, an acylamino group, preferably, those having 1 to 40 carbon atoms, a sulfonamido group, preferably, those having 1 to 40 carbon atoms; a ureido group, preferably, those having 1 to 40 carbon atoms, a hydrazinocarbonylamino group, preferably, those having 1 to 40 carbon atoms, a hydroxyl group and a phosphoamido group, preferably, those having 1 to 40 carbon atoms.

It is preferable that A is to contain at least one antidiffusion group or a silver halide adsorption accelerating group. The above-mentioned antidiffusion groups include, preferably, a ballast group that may commonly be used in an immobile additive for photographic use such as a coupler. Such a ballst group as mentioned above includes, for example, those having not less than 8carbon atoms, that is relatively inert against photographic characteristics, such as an alkyl group, an alkinyl group, an alkoxy group, a phenyl group, a phenoxy group and an alkylphenoxy group.

The silver halide adsorption accelerating groups include, for example, thiourea, a thiourethane group, a mercapto group, a thioether group, a thione group, a heterocyclic group, a heterocyclic thioamido group, a heterocyclic mercapto group and an adsorption group given in JP OPI Publication No. 64-90439/1989.

B represents, concretely, the following groups; namely, an acyl group such as those of formyl, acetyl, propionyl, trifluoroacetyl, methoxyacetyl, phenoxyacetyl, methylthioacetyl, chloroacetyl, benzoyl, 2-hydroxymethylbenzoyl and 4-chlorobenzoyl, an alkylsulfonyl group such as those of methanesulfonyl and 2-chloroethanesulfonyl, an arylsulfonyl group such as those of benzenesulfonyl, an alkylsulfinyl group such as those of methanesulfinyl, an arylsulfinyl group such as those of benzenesulfinyl, a carbamoyl group such as those of methoxycarbonyl and methoxyethoxycarbonyl, an aryloxycarbonyl group such as those of phenoxycarbonyl, a sulfamoyl group such as those of dimethylsulfamoyl, a sulfinamoyl group such as those of methylsulfinamoyl, an alkoxysulfonyl group such as those of methoxysulfonyl, a thioacyl group such as those of. methylthiocarbonyl, a thiocarbamoyl group such as those methylthiocarbamoyl, a

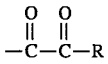

group of which R will be detailed later in formula Ha, or a heterocyclic group such as those of pyridine ring and pyridinium ring.

B denoted in formula H is allowed to form

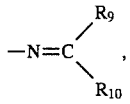

together with $A_2$ and a nitrogen atom to which B and $A_2$ are coupled.

$R_9$ represents an alkyl group, an aryl group or a heterocyclic group, and $R_{10}$ represents a hydrogen atom, an alkyl group, an aryl group or a heterocyclic group.

As for B, an acyl group or a

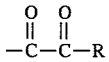

group is particularly preferred.

$A_1$ and $A_2$ represent each a hydrogen atom, and one of $A_1$ and $A_2$ represents a hydrogen atom and the other represents an acyl group such as those of acetyl, trifluoroacetyl or benzoyl, a sulfonyl group such as those of methanesulfonyl or toluenesulfonyl or a

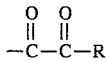

group.

Among the hydrazine compounds applicable to the invention, those particularly preferable include, for example, a compound represented by the following formula Ha.

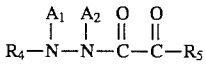

Formula Ha wherein $R_4$ represents an aryl group or a heterocyclic group, and $R_5$ represents an

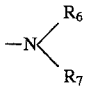

group or —$OR_8$ group.

$R_6$ and $R_7$ represent each a hydrogen atom, an alkyl group, an alkenyl group, an alkinyl group, an aryl group, a heterocyclic group, an amino group, a hydroxyl group, an alkoxy group, an alkenyloxy group, an alkinyloxy group, an aryloxy group or a heterocyclic-oxy group, provided that $R_6$ and $R_7$ may form a ring, together with the N tom; $R_8$ represents a hydrogen atom, an alkyl group, an alkenyl group, an alkinyl group, an aryl group or a heterocyclic group; and $A_1$ and $A_2$ represent each a groups synonymous with the groups represented by $A_1$ and $A_2$ each denoted in formula H, respectively.

The aryl groups represented by $R_4$ are preferable to be those having a single ring or a condensed ring including, for example, a benzene ring or a! naphthalene ring.

The heterocyclic groups represented by $R_4$ are preferable to be a 5- or 6-membered unsaturated single or condensed heterocyclic ring containing a nitrogen, a sulfur or an oxygen. The above-mentioned rings include, for example, a pyridine ring, a quinoline ring, a pyrimidine ring, a thiophene ring, a furan ring, a thiazole ring and a benzothiazole ring.

The preferable $R_4$ include, for example, a substituted or unsubstituted aryl group. Such a substituent as mentioned above include, for example, those synonymous with the substituents for A denoted in formula H. When a developer having a pH of not higher than 11.2 is used to obtain a high contrast image, it is preferable to have at least one sulfonamide group.

$A_1$ and $A_2$ represent each a group synonymous with a group represented by $A_1$ and $A_2$ denoted in formula H. In this case, it is most preferable when $A_1$ and $A_2$ represent both a hydrogen atom.

$R_5$ represents an

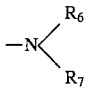

group or an —$OR_8$ group, wherein $R_6$ and $R_7$ represent each a hydrogen atom, an alkyl group such as those of ethyl, ethyl or benzyl, an alkenyl group such as those of ally or butenyl, an alkinyl group such as those of propargyl or butynyl, an aryl group such as those of phenyl or naphthyl, a heterocyclic group such as those of 2,2,6,6-tetramethylpiperidinyl, N-benzylpiperidinyl, quinolidinyl, N,N'-diethylpyrazolidinyl, N-benzylpyrrolidinyl or pyridyl, an amino group such as those of amino, methylamino, dimethylamino or dibenzylamino, a hydroxyl group, an alkoxy group such as those of methoxy or ethoxy, an alkenyloxy group such as those of allyloxy, an alkinyloxy group such as those of propargyloxy, an aryloxy group such as those of phenoxy, or a heterocyclic-oxy group such as those of pyridyloxy, provided that $R_6$and $R_7$ may form a ring such as piperidine or morpholine ring together with the nitrogen atom; and $R_8$ represents a hydrogen atom, an alkyl group such as those of methyl, ethyl, methoxyethyl or hydroxyethyl, an alkenyl group such as those of allyl or butenyl, or a heterocyclic group such as those of 2,2,6,6-tetramethylpiperidinyl, N-methylpiperidinyl or pyridyl.

Some concrete examples of the compounds represented by formulas H and Ha will be given below.

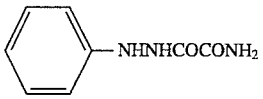

H-1

-continued
H-2
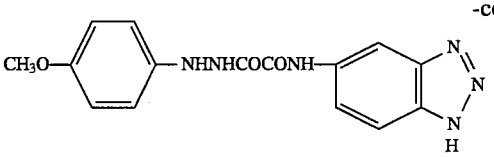
H-3
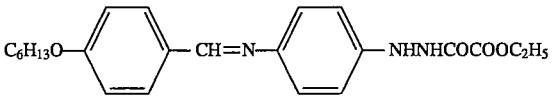
H-4
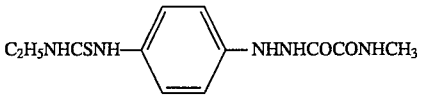
H-5
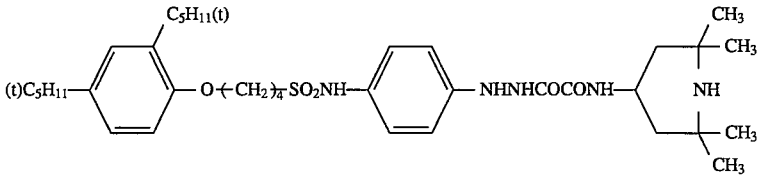
H-6
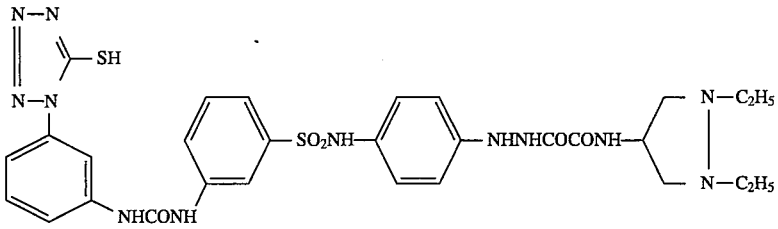
H-7
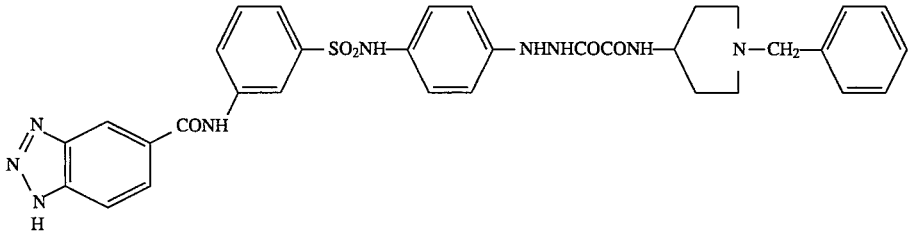
H-8
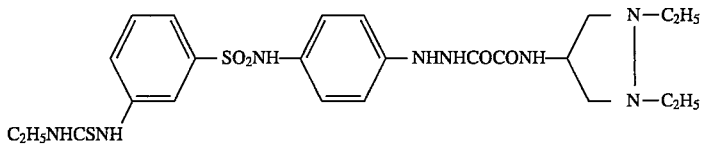
H-9
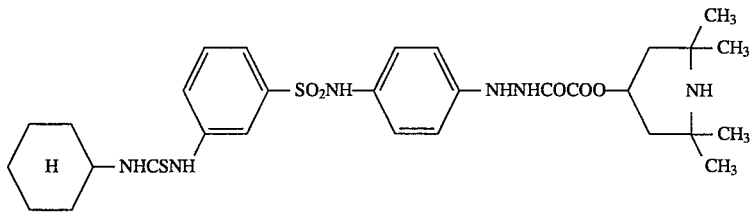
H-10
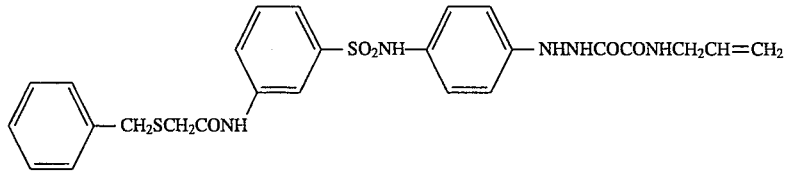

-continued
H-11
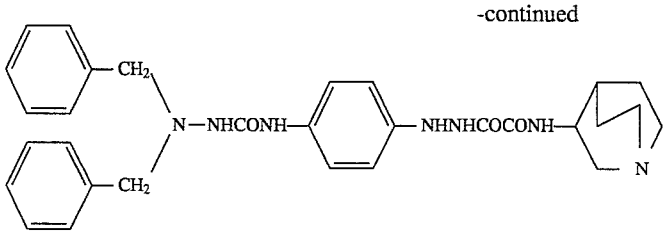
H-12
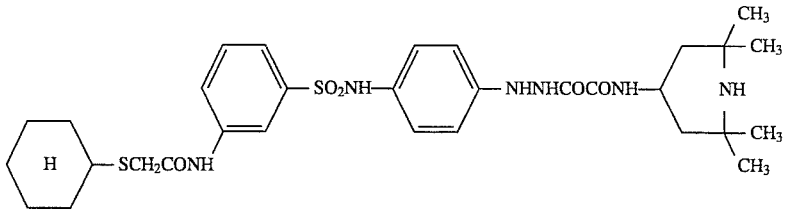
H-13
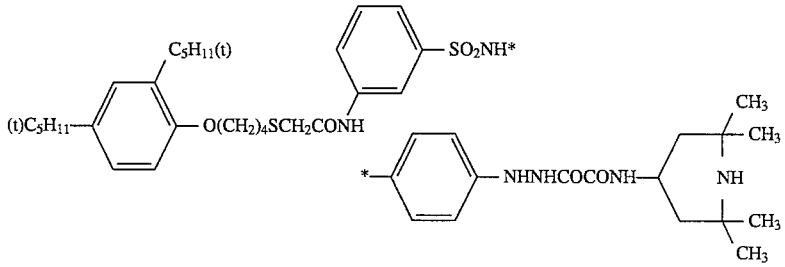
H-14
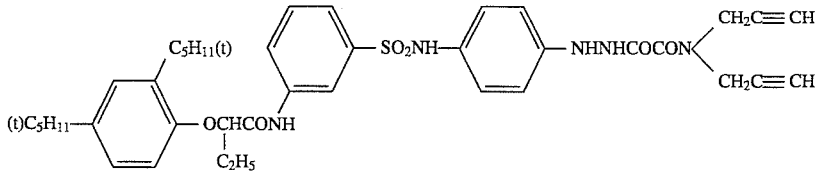
H-15
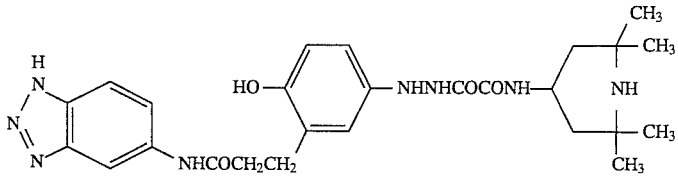
H-16
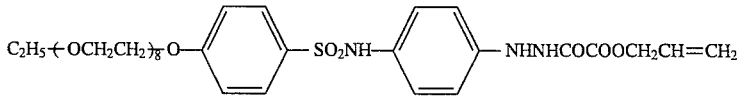
H-17
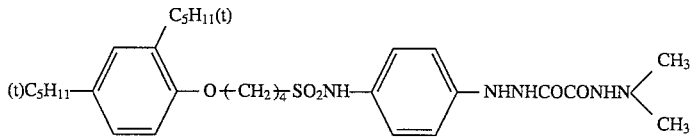
H-18
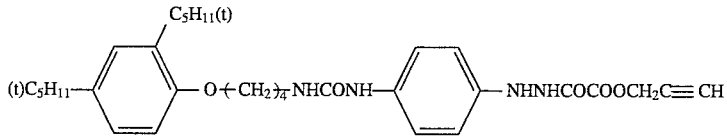
H-19
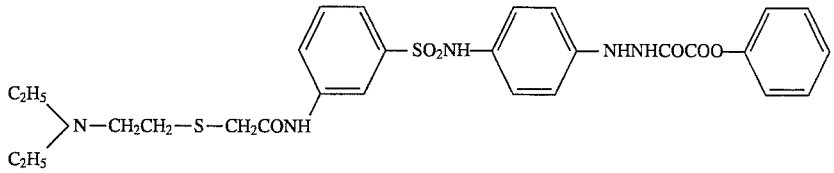

-continued
H-20
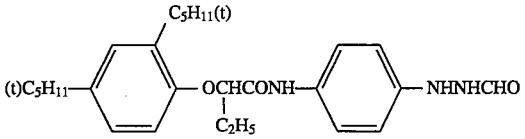
H-21
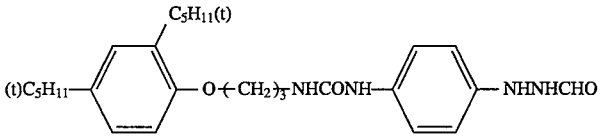
H-22
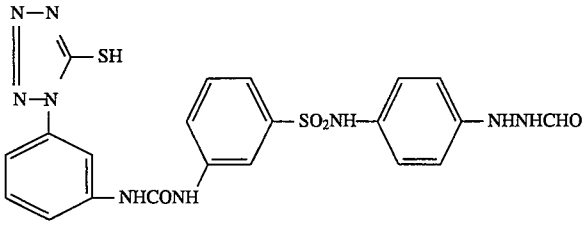
H-23
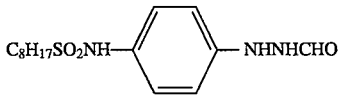
H-24
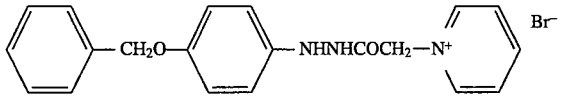
H-25
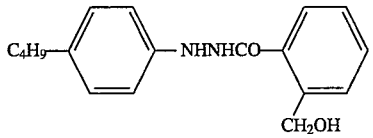
H-26
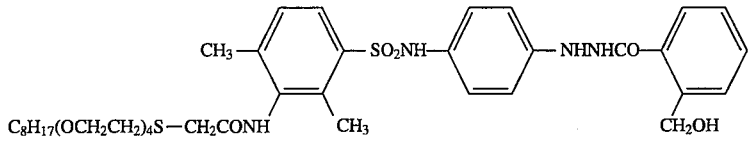
H-27
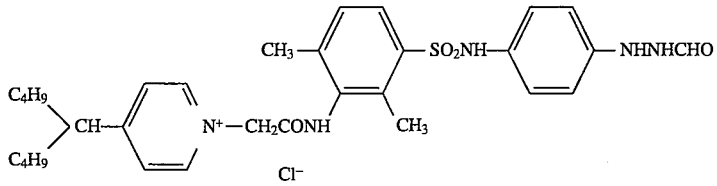
H-28
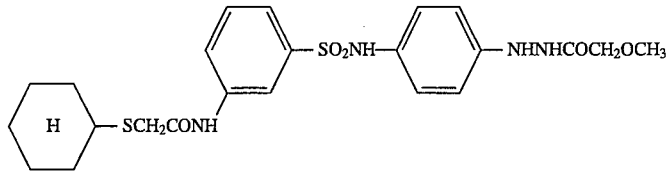
H-29
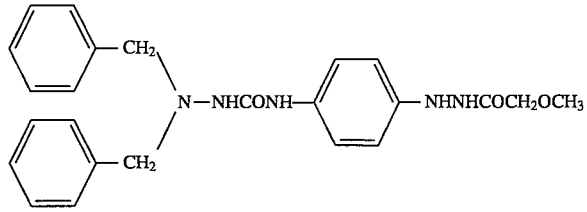

-continued
H-30
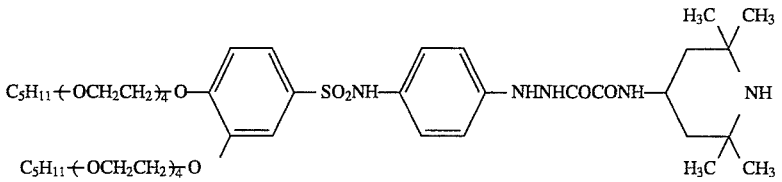
H-31
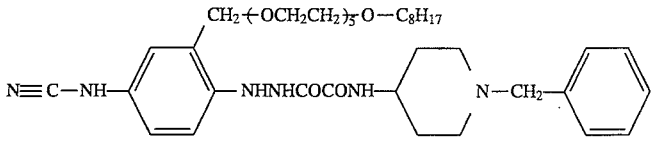
H-32
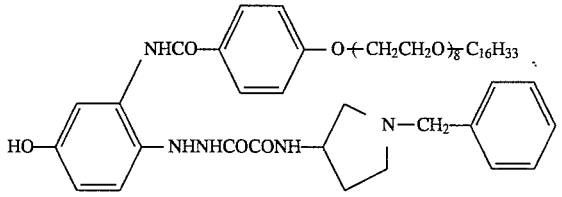
H-33
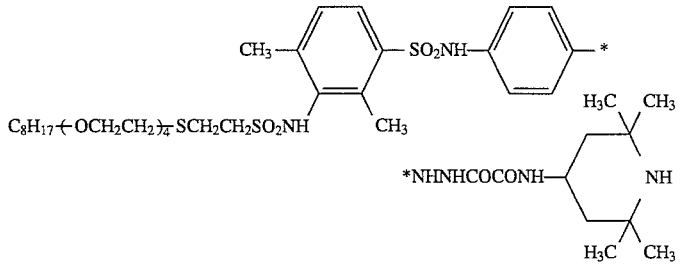
H-34
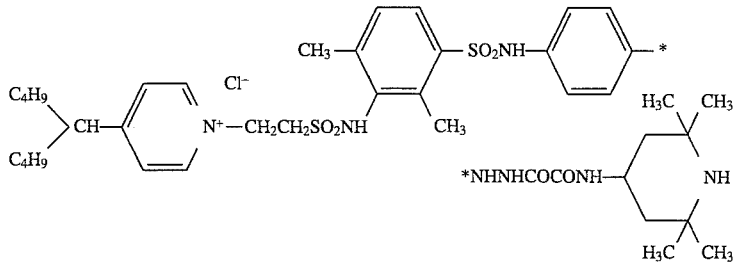
H-35
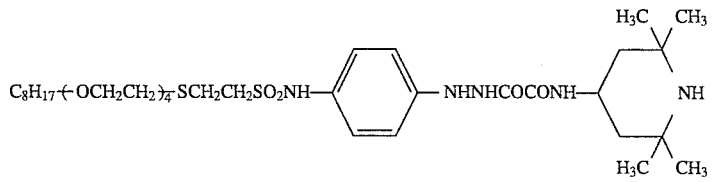
H-36
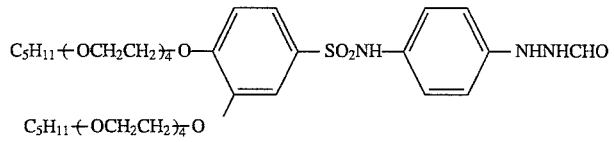
H-37
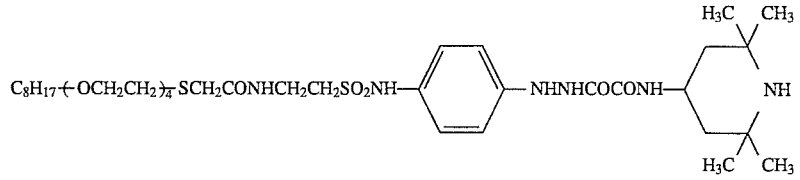

-continued
H-38
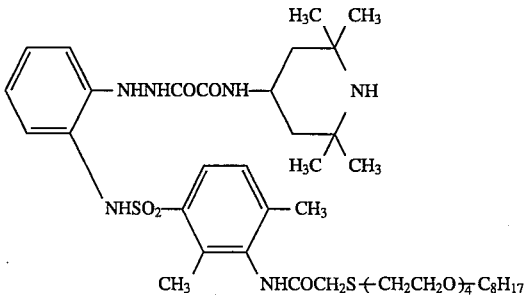
H-39
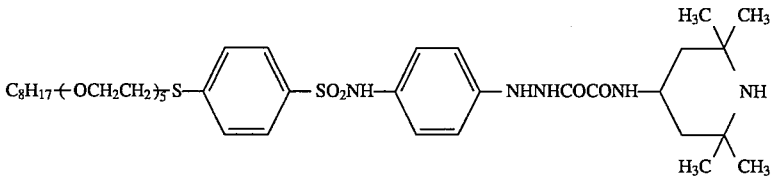
H-40
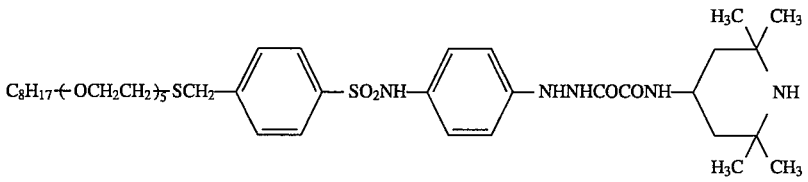
H-41
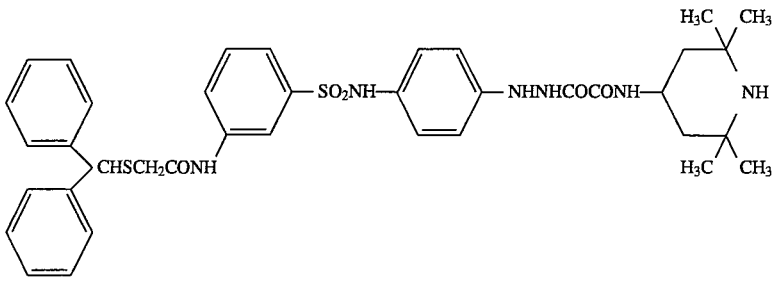
H-42
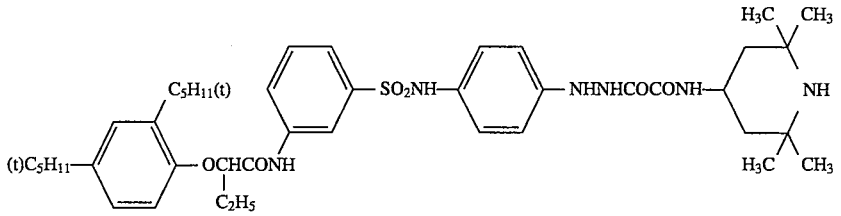
H-43
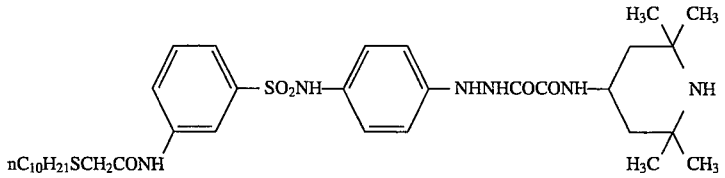
H-44
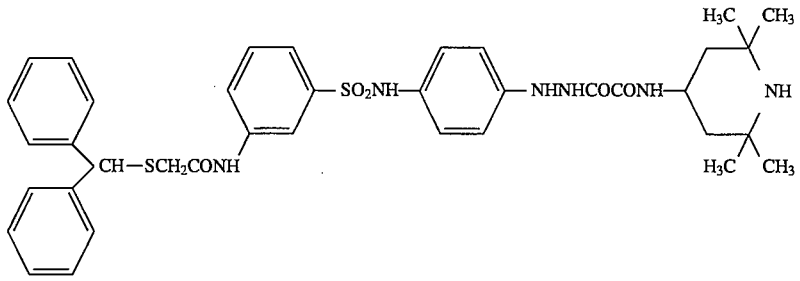

The methods for synthesizing the compounds having formula H which are applicable to the invention may be referred to the synthesizing methods detailed in, for example, JP OPI Publication Nos. 62-180361/1987, 62-178246/1987, 63-234245/1988, 63-234246/2988,64-90439/1989, 2-37/1990, 2-841/1990, 2-947/1990, 2-120736/1990, 2-230233/1990 and 3-125134/1991, U.S. Pat. Nos. 4,686,167, 4,988,604 and 4,994,365, and European Patent Nos. 253,665 and 333,435.

The compounds having formula H which are applicable to the invention may be used in an amount within the range of, preferably, $5\times10^{-7}$ to $5\times10^{-1}$ mols and, particularly, $5\times10^{-6}$ to $5\times10^{-2}$ mols per mol of silver halide used.

Now, the nucleation accelerators represented by formula 1 which are applicable to the invention will be detailed.

Formula 1

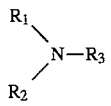

in formula 1, $R_1$, $R_2$ and $R_3$ represent each a hydrogen atom, an alkyl group, a substituted alkyl group, an alkenyl group, a substituted alkenyl group, an alkinyl group, an aryl group or a substituted aryl group, provided that $R_1$, $R_2$ and $R_3$ are not hydrogen atoms at the same time and $R_1$, $R_2$ and $R_3$ may form a ring, and it is particularly preferable when they represent each an aliphatic tertiary amine compound. These compounds are preferable to have an antidiffusion group or a silver halide adsorption group in the molecule thereof. For providing an antidiffusion property thereto. A compound represented by formula 1 is to have a molecular weight of, preferably, not less than 100 and, more preferably, not less than 300. The preferable silver halide adsorption groups include, for example, a heterocyclic group, a mercapto group, an alkylenoxide group, a —S— linkage, a

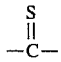

group and an

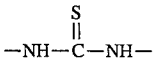

group. P The typical compounds thereof include, for example, the following compounds.

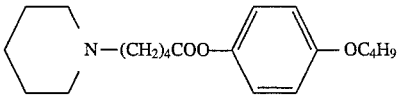

1-1

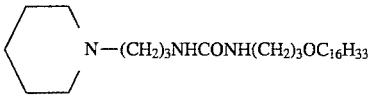

1-2

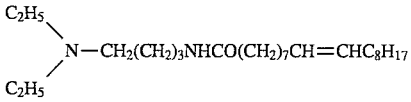

1-3

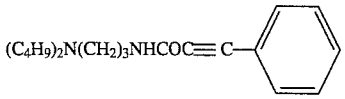

1-4

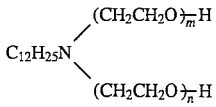

m = 0 to 20
n = 0 to 20 and
m + n = 20

1-5

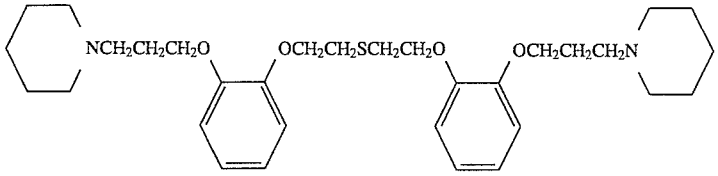

1-6

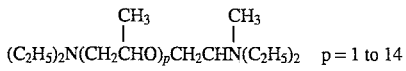

p = 1 to 14

1-7

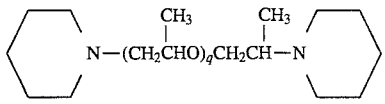

q = 1 to 12

1-8

-continued
1-9
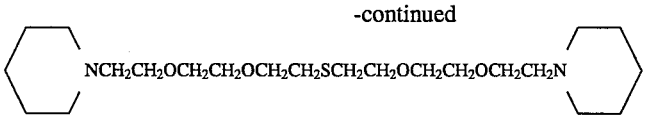
1-10
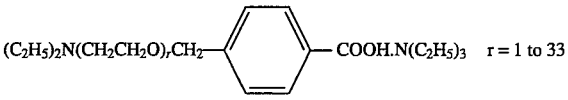
1-11
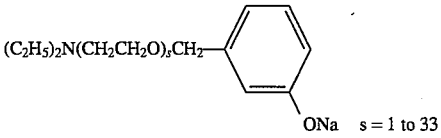
1-12
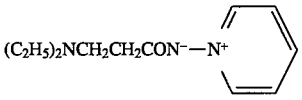
1-13
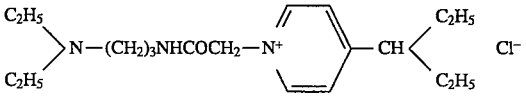
1-14
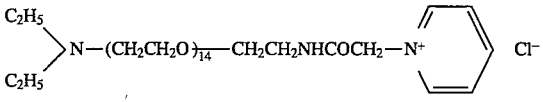
1-15
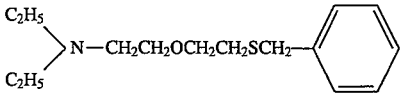
1-16
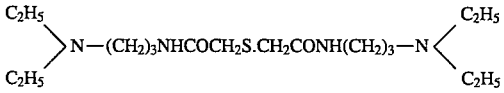
1-17
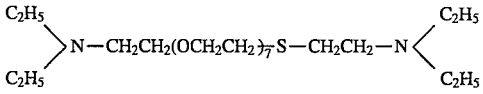
1-18
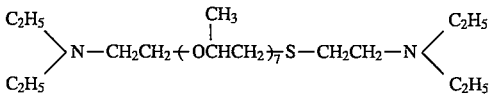
1-19
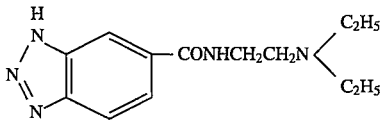
1-20
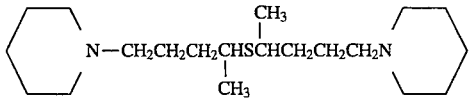
1-21
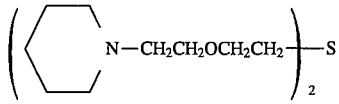
1-22
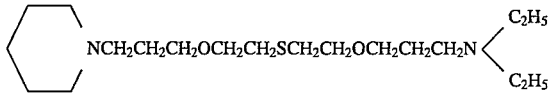

-continued

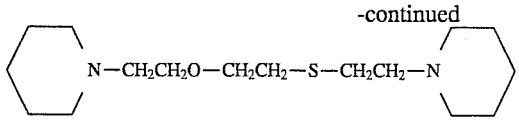

1-23

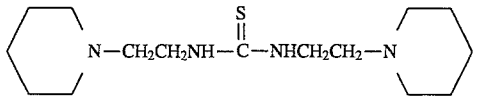

1-24

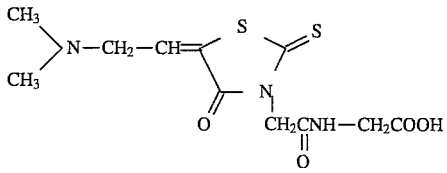

1-25

It is preferable to contain these nucleation accelerators in a hydrophilic colloidal layer containing a dispersed solid particles of hydrazine derivative and/or another hydrophilic colloidal layer adjacent to the above-mentioned colloidal layer.

It is preferable to add such a nucleation accelerator as mentioned above in an amount within the range of $1\times10^{-7}$ to $1\times10^{-1}$ mols per mol of silver. It is also preferable to add in a mol amount within the range of 1/100 to 100 times as much as the mol amount of a hydrazine derivative added. It is particularly preferable to add in a mol amount within the range of 1/20 to 20 times as much.

The improvements of a running stability may be materialized in the embodiments of the invention, regardless of the kinds of developers. Particularly when treating with a developer without containing any nucleation accelerator having formula 1, a preferable running stability can be enjoyed. Further, when the pH of a developer is lower than 11, a more preferable result can be enjoyed.

In the above-mentioned case, the expression, "without containing any nucleation accelerator having formula 1", herein means that any nucleation accelerator having formula 1 is not contained in a developer before treating a light-sensitive material, that is so-called a mother liquid, nor contained in a replenisher that may be so added as to meet the treatment and/or aging of a light-sensitive material. The scope of the embodiments of the invention also include that a nucleation accelerator having formula 1 is made effluent according to the treatment of a light-sensitive material from the light-sensitive material to a developer.

In a silver halide photographic light-sensitive material applicable to the invention, a well-known technique such as an emulsion preparation, an additive, a support and a coating technique can be used. In a treatment, a variety of well-known processing formulas and processing methods may also be used. In particular, a technique for a light-sensitive material for photomechanical use can be used.

EXAMPLES

Example 1

Preparation of silver halide emulsion A

A silver chloroiodobromide emulsion was so prepared in a double-jet precipitation method as to comprise silver chloride in a proportion of 70 mol %, silver iodide in a proportion of 0.2 mol % and silver bromide as the rest of the proportion. When making the double-jet precipitation, $K_3RhBr_6$ was added in an amount of $8.1\times10^{-8}$ mols per mol of silver used. The resulting emulsion was proved to be a cubic emulsion having an average grain-size of 0.20 μm and comprising monodisperse type grains having a variation coefficient of 9%. Then, the emulsion was desalted by making use of such a modified gelatin as described in JP OPI Publication No. 2-280139/1990 in which an amino group contained in the gelatin was substituted by phenyl carbamyl as given G-8 in JP OPI Publication No. 2-280139/1990. After completing the desalting treatment, the resulting EAg was proved to be 190 mv at 50° C. EAg was the potential of a silver electrode immersed in an emulsion to be measured as the standard electrode, a saturated calomel electrode was used.

After the resulting emulsion was adjusted to have a pH of 5.58 and an EAg of 123 mv, chloroauric acid was added in an amount of $2.2\times10^{-5}$ mols per mol of silver after setting the temperature at 60° C. After stirring the mixture thereof for 2 minutes, elemental sulphur $8 was added in an amount of $2.9\times10^{-6}$ mols per mol of silver and, further, a chemical ripening was carried out for 78 minutes. When completing the ripening, the following compounds were added in the following amounts each per mol of silver, respectively.

4-hydroxy-6-methyl-1,3,3a,7-tetrazaindene in an amount of $7.5\times10^{-3}$ mols, 1-phenyl-5-mercaptotetrazole in an amount of $3.5\times10^{-4}$ mols and gelatin in an amount of 28.4 g were so added as to prepare an emulsion solution.

(Preparation of a hydrozine derivative dispersion solution)

Each of the hydrazine derivatives shown in Table 1 was pulverized for 5 days by making use of a ball-mill using zirconium oxide balls, so that powder having a particle-size of 0.01 μm could be obtained. The resulting powder was mixed with water and was then PD dispersed at 2000 rpm for 3 hours, so that a very tacky dispersion solution could be obtained.

(Preparation of a silver halide photographic light-sensitive material)

A 100 μm-thick polyethylene terephthalate film was antistatically processed in such a manner as described in JP OPI Publication No. 3-92175/1991. On the sublayer coated on one side of the film base, a silver halide emulsion having the following recipe 1 was so coated so that the silver content could be 3.3 g/m$^2$ and the gelatin content could be 2.6 g/m$^2$.

For the purpose of a comparison thereto, a sample was prepared by adding a hydrazine derivative in the state where the derivative was dissolved in a methanol solvent.

Further, on the upper layer thereof, a coating solution having the following recipe 2 was coated so that the gelatin content thereof could be 1 g/m$^2$ so as to serve as a protective layer. On the opposite side of the sublayer, a backing layer having the following recipe 3 was coated so that the gelatin content could be 2.7 g/m$^2$ and, further thereon, a protective layer having the following recipe 4 was coated so that the gelatin content could be 1 g/m$^2$. Thereby, 9 kinds of samples shown in Table 1 were prepared.

Recipe 1: Composition of a silver halide emulsion layer

Sensitizing dye — 6.0 mg/mg$^2$

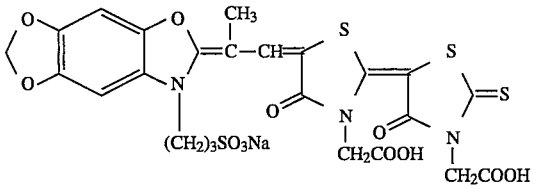

Hydrazine derivative (shown in Table 1) — 100 mg/m$^2$
$2 \times 10^{-4}$ mols/mol of Ag

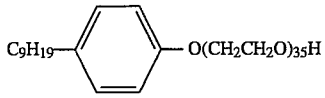

Latex polymer — 0.5 g/m$^2$

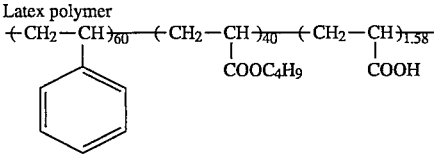

Mw = 300000

Hardener — 60 mg/m$^2$

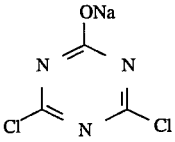

| | |
|---|---|
| S-1 (Sodium-iso-amyl-n-decyl sulfosuccinate) | 0.64 mg/m$^2$ |
| 2-mercapto-6-hydroxy purine | 1.7 g/m$^2$ |
| EDTA | 50 mg/m$^2$ |

The hydrazine derivatives were added in the following two kinds of states.
X: added in the form of a dispersion of solid particles;
and
Y: Added in the form of a methanol solution.

Recipe 2: Composition of an emulsion protective layer

| | |
|---|---|
| S-1 | 12 mg/m$^2$ |
| Matting agent: Monodisperse silica having an average particle-size of 3.5 μm | 22 mg/m$^2$ |
| 1,3-vinyl sulfonyl-2-propanol | 40 mg/m$^2$ |
| Nucleation accelerator, (Exemplified compound 1-12) | 250 mg/m$^2$ |
| Surfactant | 0.6 mg/m$^2$ |

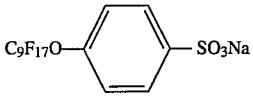

Recipe 3: Composition of backing layer

| | |
|---|---|
| Saponin | 133 mg/m$^2$ |
| S-1 | 6 mg/m$^2$ |
| Colloidal silica | 100 mg/m$^2$ |

-continued

Dye (a) 30 mg/m²

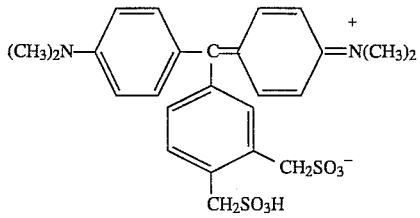

Dye (b) 75 mg/m²

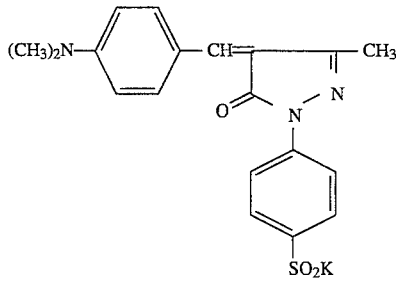

Dye (c) 30 mg/m²

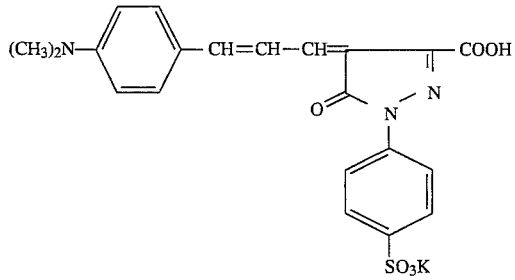

Hardener 100 mg/m²

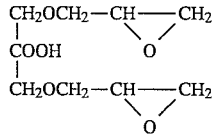

Recipe 4: Composition of backing protective layer

| | |
|---|---|
| Matting agent: Monodisperse type polymethyl methacrylate having an average particle-size of 5.0 μm | 50 mg/m² |
| Sodium-di-(2-ethylhexyl)-sulfoasuccinate | 10 mg/m² |

The resulting sample was brought into close contact with an optical step-wedge and was then exposed to light having a wavelength of 633 nm having the substitutive characteristics of He-Ne laser beam. After making the exposure, the sample was processed through a rapid processing automatic processor CR-26SR manufactured by Konica Corp. by making use of the developer and fixer each having the following compositions, under the following conditions.

Two series of processing were carried out, in one of which the developer Use in the state of a fresh solution after a developer was prepared. In another series, the developer was use in a state of after running. The running of the developer was carried out until the replenishment was made double as much as the developing tank capacity of the automatic processor. In the course of the running a replenisher having the same composition of the developer was replenished to the developer in a ratio of 100 ml per m² of processed light-sensitive material. In the processing, the fixer was replenished in an amount of 150 ml/m².

After completing the running test, the developer was allowed to stand for 24 hours while keeping it at 35° C., and the development was then carried out. In the development, the treatment was carried out after the developer was replenished until the developing tank was overflown, because the developer level was lowered.

Developer A

| | |
|---|---|
| Sodium sulfite | 55 g |
| Potassium carbonate | 40 g |
| Hydroquinone | 24 g |
| 4-methyl-4-hydroxymethyl-1-phenyl- | 0.9 g |

-continued

| | |
|---|---|
| 3-hydrazolidone, (Dimeson S) | |
| Potassium bromide | 5 g |
| 5-methyl-benzotriazole | 0.13 g |
| Boric acid | 2.2 g |
| Diethylene glycol | 40 g |
| 2.Mercapto hypoxanthine | 60 mg |
| Add water and potassium hydroxide to make | 1 liter |
| Adjust pH to be | 10.5 |
| Fixer | |
| (Composition A) | |
| Ammonium thiosulfate (in an aqueous 72.5% W/V solution) | 240 ml |
| Sodium sulfite | 17 g |
| Sodium acetate, trihydrate | 6.5 g |
| Boric acid | 6.0 g |
| Sodium citrate, dihydrate | 2.0 g |
| (Composition B) | |
| Pure water (ion-exchange water) | 17 ml |
| Sulfuric acid, (in an aqueous 50% W/V solution) | 4.7 g |
| Aluminum sulfate, (in an aqueous solution having a 8.1% W/V content equivalent to $Al_2O_3$) | 26.5 g |
| When making use of the fixer, the above-mentioned composition A and composition B were dissolved in this order in 500 ml of water and then to make | 1 liter |
| The pH of the fixer was adjusted with acetic acid to be | 4.8 |

Development conditions

| Step | Temperature | Time |
|---|---|---|
| Developing | 35° C. | 30 sec. |
| Fixing | 33° C. | 20 sec. |
| Washing | An ordinary temp. | 20 sec. |
| Drying | 40° C. | 40 sec. |

The resulting developed sample was measured through a digital densitometer(Model PDA-65 manufactured by Konica Corp.). In the table, the sensitivity is indicated by a sensitivity relative to the sensitivity of sample No. 1 when it had a density of 3.0, that was regarded as a standard value of 100. The gamma is indicated by a tangential value between the densities of 0.1 and 3.0. When a gamma value in the table is lower than 6, the subject light-sensitive material is not applicable and, even when a gamma is within the range of not lower than 6 to lower than 10, the contrast of the subject light-sensitive material is still not enough. When a gamma value can be not lower than 10, the subject light-sensitive material can satisfactorily be used practically, because an extrahard contrast image can be provided therefrom.

The results obtained therefrom will be shown below.

TABLE 1

| | Hydrazine [II] | | Sensitivity*2 | | Gamma | |
|---|---|---|---|---|---|---|
| Sample No. | Kind | Adding method | N | R | N | R |
| 1 | 41 | X | 105 | 98 | 18 | 17 |
| 2 | 42 | X | 104 | 99 | 24 | 23 |
| 3 | 43 | X | 101 | 97 | 21 | 20 |
| 4 | 44 | X | 100 | 95 | 23 | 21 |
| 5 | 26 | X | 103 | 94 | 24 | 22 |
| 6 | 28 | X | 104 | 98 | 22 | 20 |
| 7 | 34 | X | 110 | 102 | 21 | 19 |
| 8 | 41 | Y | 100 | 76 | 17 | 6 |
| 9 | 42 | Y | 100 | 74 | 22 | 8 |

TABLE 1-continued

| | Hydrazine [II] | | Sensitivity*2 | | Gamma | |
|---|---|---|---|---|---|---|
| Sample No. | Kind | Adding method | N | R | N | R |
| 10 | 43 | Y | 100 | 68 | 20 | 9 |
| 11 | 44 | Y | 100 | 65 | 21 | 8 |
| 12 | 26 | Y | 100 | 63 | 21 | 8 |
| 13 | 28 | Y | 100 | 62 | 20 | 7 |
| 14 | 34 | Y | 100 | 71 | 19 | 9 |

*1X: Solid-dispersion solution
Y: Methanol solution
N: Fresh solution
R: Solution for running treatments As is obvious from Table 1, the samples of the invention added with a hydrazine derivative in the solid-dispersed state (X) were proved that the sensitivities and hard contrast characteristics thereof cannot be spoiled even after completing a running:treatments.

Comparative example 1

The evaluation was tried in the same manner as in Example 1, except that the nucleation accelerator was removed from the light-sensitive material used in Example 1 and developer B added respectively with nucleation accelerator 1–12 in an amount of 10 g/liter to developer A.

The results thereof will be shown in Table 2 given below.

TABLE 2

| | Hydrazine [II] | | Sensitivity*2 | | Gamma | |
|---|---|---|---|---|---|---|
| Sample No. | Kind | Adding method | N | R | N | R |
| 15 | 41 | X | 105 | 82 | 19 | 10 |
| 16 | 42 | X | 103 | 81 | 20 | 12 |
| 17 | 43 | X | 102 | 82 | 23 | 14 |
| 18 | 44 | X | 103 | 84 | 22 | 13 |
| 19 | 26 | X | 101 | 80 | 21 | 12 |
| 20 | 28 | X | 107 | 82 | 22 | 10 |
| 21 | 34 | X | 104 | 84 | 24 | 11 |
| 22 | 41 | Y | 100 | 54 | 18 | 6 |
| 23 | 42 | Y | 100 | 52 | 21 | 4 |
| 24 | 43 | Y | 100 | 53 | 20 | 7 |
| 25 | 44 | Y | 100 | 52 | 20 | 8 |
| 26 | 26 | Y | 100 | 48 | 21 | 7 |
| 27 | 28 | Y | 100 | 46 | 18 | 8 |
| 28 | 34 | Y | 100 | 51 | 19 | 6 |

When comparing the results shown in Table 2 to those shown in Table 1, the following facts were proved. Nuclation accerelator added into the light-sensitive material according to the invention is considerably effective to raise running stability compared with the effect of that added to the developer.

Example 2

Samples were prepared fin the same manner as in Example 1, except that the hydrazine derivative and nucleation accelerator were replaced by those shown below according to European Patent No. 326,433. Hydrazine derivative HM is a hydrazine compound being within the scope of the invention an nucleation accelerator NM is a compound falling without the scope of the invention. Further, samples were prepared in which the hydrazine derivative were replaced by the exemplified compounds of the invention, or that nothing of them was added thereto. The resulting samples were treated in the same manner as in Example 1 by making use of developer C prepared by changing the pH of developer A to 11.2. The results thereof will be shown in Table 3.

Hydrazine derivative HM 3 g/mol of Ag

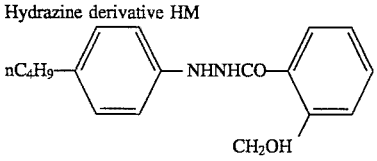

Nucleation accelerator NM
Benzhydrol 1.5 g/mol of Ag

TABLE 3

| Sample No. | Nucleation accelerator | Developer | Sensitivity N | Sensitivity R | Gamma N | Gamma R |
|---|---|---|---|---|---|---|
| 29 | NM | A | 100 | 62 | 20 | 6 |
| 30 | NM | C | 100 | 61 | 18 | 7 |
| 31 | I-12 | A | 100 | 97 | 22 | 21 |
| 32 | I-12 | C | 100 | 82 | 23 | 12 |
| 33 | I-12 | A | 100 | 98 | 21 | 19 |
| 34 | I-12 | C | 100 | 80 | 21 | 11 |
| 35 | I-12 | A | 100 | 97 | 21 | 20 |
| 36 | I-12 | C | 100 | 82 | 23 | 11 |
| 37 | I-19 | A | 100 | 99 | 22 | 20 |
| 38 | I-19 | C | 100 | 81 | 21 | 11 |
| 39 | I-21 | A | 100 | 98 | 20 | 18 |
| 40 | I-21 | C | 100 | 79 | 22 | 10 |
| 41 | I-22 | A | 100 | 98 | 20 | 19 |
| 42 | I-22 | C | 100 | 81 | 21 | 11 |
| 43 | Not used | A | 100 | 52 | 8 | 4 |
| 44 | Not used | C | 100 | 43 | 6 | 4 |

N (with fresh developer)
R (with running developer)

It was proved from the results shown in Table 3 that a nucleation accelerator represented by formula 1 is excellent in running stability and that an embodiment of the invention can display a running stability effect even when a developer has a pH of not lower than 11.0 and it can display a particularly preferable effect when a developer has a pH of lower than 11.0.

What is claimed is:

1. A method for developing a silver halide photographic light-sensitive material comprising bringing an imagewise exposed silver halide photographic light-sensitive material into contact with a developer, wherein said light-sensitive material comprises a support, bearing on the same side thereof a silver halide emulsion layer and optionally a hydrophilic colloid layer, at least one of said silver halide emulsion layer and said hydrophilic colloid layer containing a hydrazine derivative in a form of dispersed solid particles, and at least one of said silver halide emulsion layer and said hydrophilic colloid layer containing nucleation accelerator represented by Formula 1, said developer containing no compound represented by Formula 1 and having a pH less than 11.0;

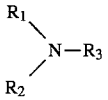

(1)

wherein $R_1$, $R_2$ and $R_3$ are independently a hydrogen atom, an alkyl group, an alkenyl-group or an aryl group, $R_1$, $R_2$ and $R_3$ are not a hydrogen atom at the same time and two of $R_1$, $R_2$ and $R_3$ may link to form a ring, and at least one of $R_1$, $R_2$ and $R_3$ is a group having a heterocyclic group, a mercapto group, an alkylene oxide group, an —S— linkage, a

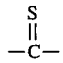

group, or a

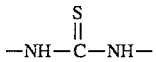

group.

2. The method of claim 1 wherein said nucleation accelerator has a molecular weight of not lower than 100.

3. The method of claim 2 wherein said nucleation accelerator has a molecular weight of not lower than 300.

4. The method of claim 1 wherein said nucleation accelerator is an aliphatic tertiary amine.

5. The method of claim 1 wherein said nucleation accelerator is contained in said emulsion layer or said hydrophilic colloid layer in an amount of $1\times10^{-7}$ mol to $1\times10^{-1}$ mol per mol silver contained in said silver halide emulsion layer.

6. The method of claim 1 wherein said hydrazine derivative is a compound represented by formula H;

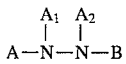

(H)

wherein A is an aliphatic group, an aromatic group or a heterocyclic group; $A_1$ and $A_2$ each a hydrogen atom or one of which is a hydrogen atom and another one is an acyl group, a sulfonyl group or a

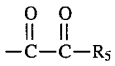

group, in which $R_5$ is a

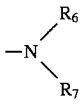

group or a —$OR_8$ group, in which $R_6$ and $R_7$ are each a hydrogen atom, an alkyl group, an alkenyl group, an alkinyl group, an aryl group, a heterocyclic group, an amino group, a hydroxyl group, an alkoxy group, an alkenyloxy group, an alkinyloxy group, an aryloxy group or a heterocyclic-oxy group, and $R_8$ is a hydrogen atom, an alkyl group, an alkenyl group, an alkinyl group, an aryl group or a heterocyclic group; and B is an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, a

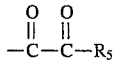

group or a heterocyclic group.

7. The method of claim 6 wherein said hydrazine derivative is a compound represented by formula Ha;

$$R_4-\overset{\overset{A_1}{|}}{N}-\overset{\overset{A_2}{|}}{N}-\overset{\overset{O}{||}}{C}-\overset{\overset{O}{||}}{C}-R_5 \quad \text{(Ha)}$$

wherein $A_1$, $A_2$ and $R_5$ are each the same as $A_1$, $A_2$ and $R_5$ defined in formula H; and $R_4$ is an aryl group or a heterocyclic group.

8. The method of claim 1 wherein said hydrazine derivative is contained in said emulsion layer or said hydrophilic colloid layer in an amount of $1\times10^{-7}$ mol to $1\times10^{-1}$ mol per mol silver contained in said silver halide emulsion layer.

9. The method of claim 1 wherein the ratio of the amount of said hydrazine derivative to that of said nucleation accelerator is 1:100 to 100:1.

10. The method of claim 1 wherein said hydrazine derivative is contained in said silver halide emulsion or in a hydrophilic colloid layer adjacent to said silver halide emulsion layer.

11. The method of claim 1 wherein said nucleation accelerator is contained in the layer in which said hydrazine derivative is contained adjacent to said layer or the layer adjacent to said hydrazine derivative-containing layer.

* * * * *